US005374165A

United States Patent [19]

Fähnle

[11] Patent Number: 5,374,165

[45] Date of Patent: Dec. 20, 1994

[54] PUMP WITH HYDROSTATIC PISTON ELEMENTS AND WITH AXIAL THRUST COMPENSATION

[75] Inventor: Gerhard Fähnle, Steinheim, Germany

[73] Assignee: J. M. Voith GmbH, Heidenheim, Germany

[21] Appl. No.: 114,374

[22] Filed: Aug. 30, 1993

[30] Foreign Application Priority Data

Sep. 4, 1992 [DE] Germany ..... 4229656

[51] Int. Cl.[5] ..... F04B 1/04

[52] U.S. Cl. ..... 417/273; 91/492; 92/58; 92/72

[58] Field of Search ..... 417/273; 91/492; 92/58, 92/72

[56] References Cited

U.S. PATENT DOCUMENTS 3,961,562 6/1976 Kersten et al. ..... 91/492

*Primary Examiner*—Richard A. Bertsch
*Assistant Examiner*—Alfred Basichas
*Attorney, Agent, or Firm*—Ostrolenk, Faber, Gerb & Soffen

[57] ABSTRACT

A pump with axial thrust compensation having an external housing, a main shaft within the housing to which are axially fixed two spaced apart rotors. The main shaft supports the rotors apart at respective collars against which the rotors are clamped. Each rotor including a series of radially displaceable elements within respective bores. The stroke rings for the rotors are rigidly attached to each other by a respective bearing shaft. A respective stroke ring around each rotor for moving the displaceable elements into and out of the bores. A respective control slot into each of the bores in the rotor and the control slots of each rotor extending laterally toward the other rotor. A housing partition disposed between the rotors, the partition including a first partial annular inlet channel section communicating with the control slots during a part of the path of the rotors where the displaceable elements are moving out of the bores and a second partial annular outlet channel section communicating with the control slots during a part of the path of the rotors where the displaceable elements are moving into the bores.

10 Claims, 4 Drawing Sheets

PUMP WITH HYDROSTATIC PISTON ELEMENTS AND WITH AXIAL THRUST COMPENSATION

BACKGROUND OF THE INVENTION

The present invention relates to a pump for liquid using a plurality of rotors each with a respective plurality of radially arrayed pistons in the form of hydrostatic elements with the fluid passage and delivery channels to the pistons opening laterally and particularly relates to control over the effects of lateral or axial thrust forces.

A single entry, so called side loaded hydrostatic machine or fluid pump is known from Federal Republic of Germany OS 39 05 936. Means are there provided to take up or compensate for axial thrust forces which act via the drive shaft on the radial arrangement of cylinders that define a rotor. However, it has been found that the axial forces in this connection are unfavorably high and that there are pulsating radial forces that flow back over the outer surface of the machine to the bearing points, producing undesirable loud noises. Another problem is that the bearing points for the central shaft of the machine must be very precisely aligned, which results in increased manufacturing expense.

SUMMARY OF THE INVENTION

The object of the present invention is to provide a fluid pump with hydrostatic piston elements of the above mentioned type in which any pulsating forces which result from hydrostatic loading need not be conducted over the outer surfaces of the machine and in which, furthermore, technically difficult and expensive alignment of the housing covers of the machine is made unnecessary.

The invention concerns a pump with axial thrust compensation. There is an external housing. A main bearing shaft within the housing has axially fixed to it two spaced apart rotors. The main shaft supports the rotors apart at respective collars against which the rotors are clamped. Each rotor includes a series of radially displaceable elements, e.g. pistons, within respective bores. Stroke rings are provided for the rotors and are rigidly attached to each other by a respective bearing shaft. The respective stroke ring around each rotor moves the displaceable elements into and out of the bores. A respective control slot communicates into each bore in each rotor, and the control slots of each rotor extend laterally toward the other rotor. A housing partition is disposed between the rotors. The partition includes a first partial annular inlet channel section communicating with the control slots during a part of the path of the rotors where the displaceable elements are moving out of the bores and a second partial annular outlet channel section communicating with the control slots during a part of the path of the rotors where the displaceable elements are moving into the bores.

The particular advantages of this configuration or construction reside in that both the axial forces and the radial forces are taken up within the pump which avoids production of noise via the outer surfaces or housing of the pump.

Furthermore, the respective single element supports for the radial arrangement of cylinders and for the stroke rings are advantageous for manufacture of the pump.

Other features and advantages of the present invention will become apparent from the following description of the invention which refers to the accompanying drawings.

DETAILED DESCRIPTION OF THE INVENTION

Figure 1:
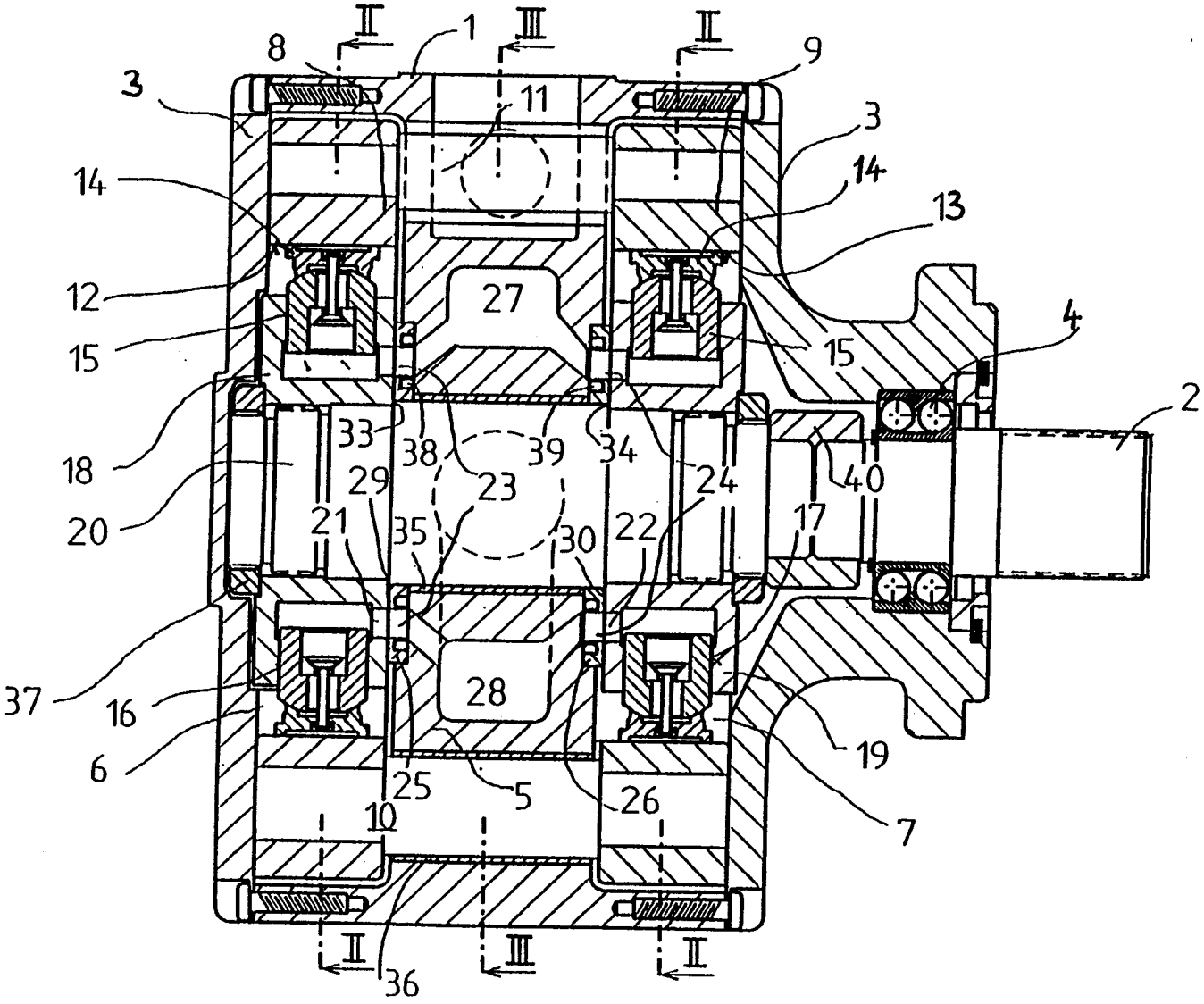
FIG. 1 is a longitudinal section through a pump or hydrostatic machine according to the invention.

The illustrated radial piston machine, which represents a pump or hydrostatic machine, has an external housing 1 with two axially separated inner chambers 6, 7 which are separated by a partition 5 that is stationary within the housing. The inner chambers 6, 7 are closed off on their outer sides by housing covers 3.

In each individual inner chamber 6, 7 there is arranged a respective stroke ring 8, 9 having a radially inwardly facing slide surface 12, 13. The rings 8, 9 are connected to each other by at least one connecting shaft 11 and by a bearing shaft 10 and are connected by bearing 36 to the partition 5.

Displacement elements slide along the inner respective slide surfaces side 12, 13 of the stroke rings 8, 9 in known manner. The displacement elements each function as a hydrostatic machine element or as a radial piston machine element. Each displacement element comprises a slide shoe or block 14 and a displacement piston 15 articulated to the block enabling the block to swing slightly relative to the piston. The pistons 15 are arranged to be moved into and out of respective radial bores 16, 17 formed in two axially spaced apart rotors 18 and 19. The pistons in bores all form a radial arrangement of cylinders, respectively, in each rotor 18 and 19. The rotors 18, 19 themselves are of a type know per se. The rotors, in turn, are coupled to a shaft 20 and are both fixed for rotation together with and are fixed axially to the shaft 20. The shaft 20 is driven to rotate via a drive bushing 2 mounted in a bearing 4.

The invention resides in the fact that the pump or hydrostatic machine does not rely on only one rotor 18, 19, but instead relies on a plurality of, and particularly on two, rotors which act synchronously with each other as motor and pump unit respectively, so that a double delivery is obtained within the same radial dimensions. Further, the drive shaft is mounted between the rotors 18, 19, because the stroke ring mounting lies between the stroke rings 8, 9 and in the partition 5.

The two rotors 18, 19 are coupled or functionally connected to each other to function together as pump elements. Respective axial or lateral control slots 21, 22 are connected into the radial bores 16, 17 of the rotors 18, 19, and the respective control slots 21 and 22 of the two rotors 18 and 19 are opposed to and face toward each other. These slots 21, 22 open the bores 16, 17 toward the partition 5. The control slots 21, 22 correspond in radial position to partially annular shaped channels 23, 24 (see FIG. 4) which are developed in control disks (axial disks) 25, 26. The control disks 25, 26 are inserted in corresponding recesses on both sides of the partition 5.

Figure 2:
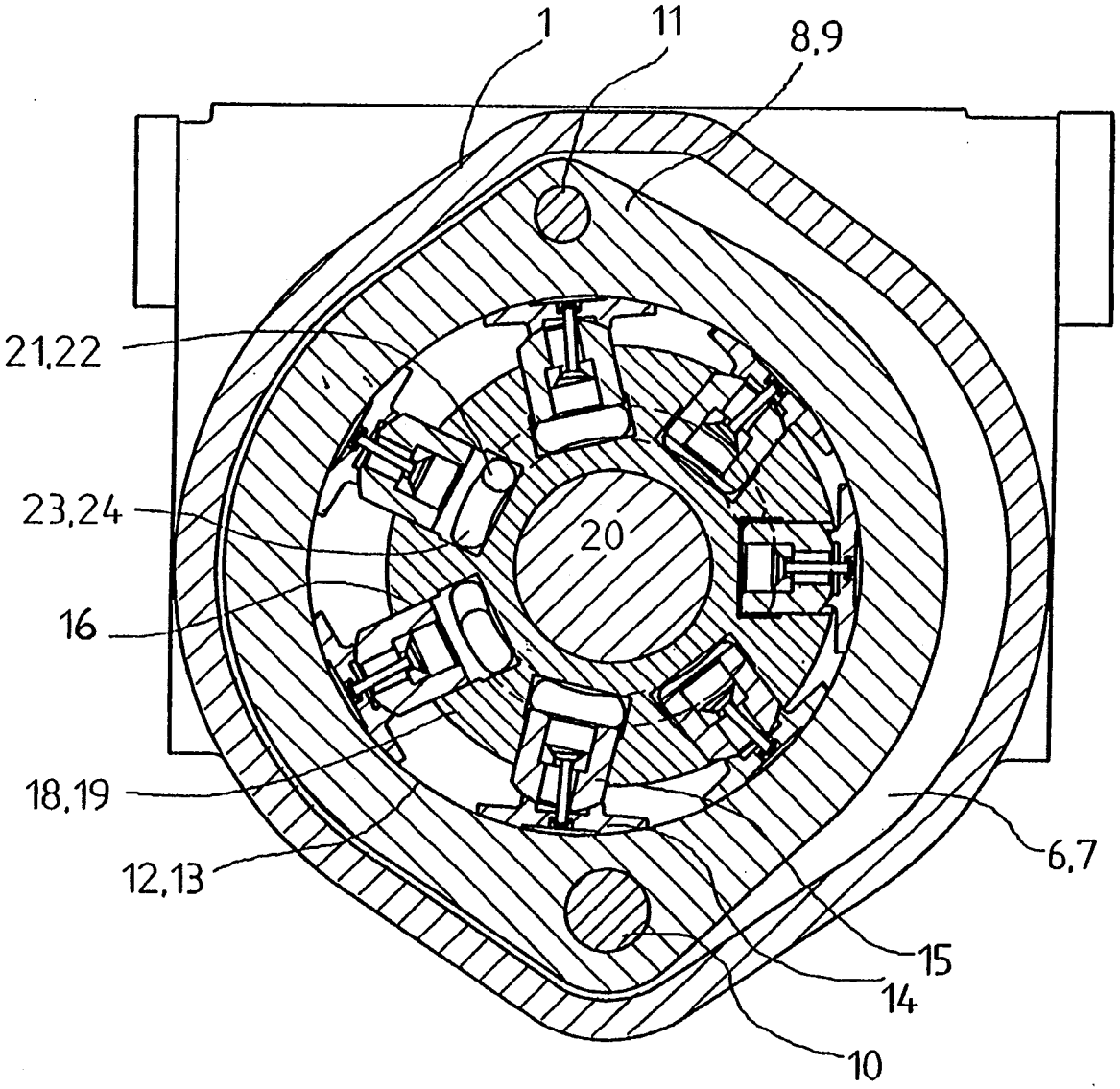
FIG. 2 is a cross section through the pump or hydrostatic machine of FIG. 1, along the section line II—II.

Transversely extending, i.e. across the axis, connecting channels 27, 28 are developed in the partition 5. The connecting channels 27, 28 form the inlet and outlet channels, respectively, of the pump and accordingly are open toward the outside of the housing. The channels 27 and 28 are connected to all of the control slots 21, 22 of both rotors 18, 19 via the channels 23, 24. The inlet channel 27 is connected through the first or top partially annular channels 23, 24 (FIG. 4) with the control slots 21, 22 that are then rotating past the top channels 23, 24 at both axial sides of the partition to supply fluid into the bores beneath the then outwardly displacing pistons. This assumes counterclockwise rotor rotation in FIG. 2. Similarly, the outlet channel 28 is connected through the second or bottom partially annular channels 23, 24 with the control slots 21, 22 then rotating past the bottom channels 23, 24 to receive fluid pumped from the bores beneath the then inwardly displacing pistons. As each of the rotors 18, 19 and each of the channels 23, 24 are at the same respective rotative positions, inlet and outlet of fluids occurs over the same arcuate part of both rotor rotations. As a result of the foregoing, both rotors 18, 19 are connected to each other via their displacement elements through the various connecting channels. They are together capable of operating as a pump or hydrostatic machine. This produces a double entry hydrostatic machine or radial piston machine.

The axial thrust produced by the laterally directed pressure on each piston 15 and its respective control slot 21, 22 is counteracted through equally large axial channels 23, 24 in the control disks 25, 26 and the pressure fields 29, 30 surrounding these channels 23, 24 in the slots between the rotors 18, 19 and the control disks 25, 26, that is through oppositely directed action of the hydrostatic forces. The force lock B between the rotors 18, 19 via the shaft 20 and the fact that the force is directed in opposite directions as to the respective rotors avoids any axial action of the force on the housing 1.

Figure 3:
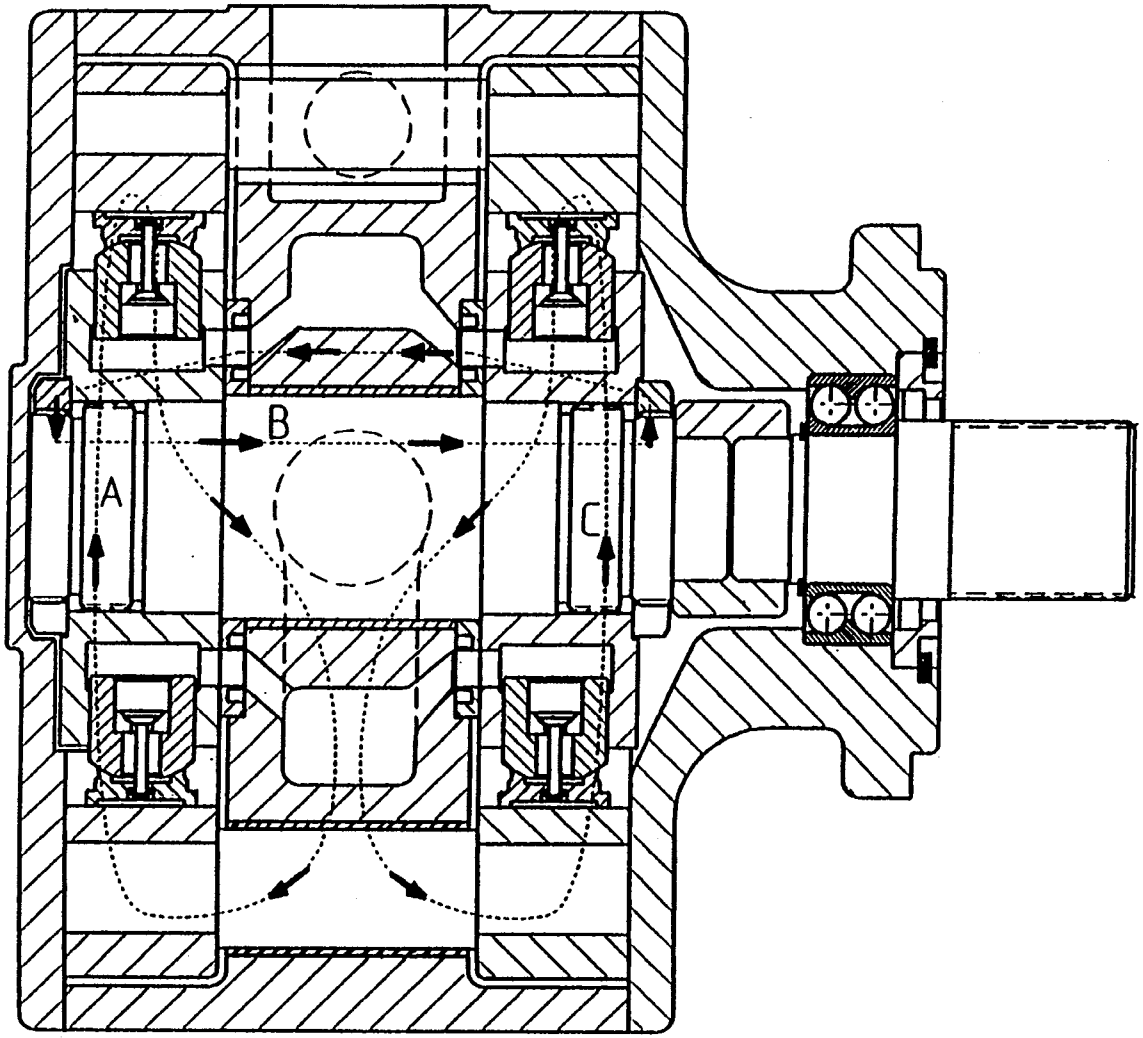
FIG. 3 is a longitudinal section through the pump or hydrostatic machine of FIG. 1, with indications of the axial and radial flows of force within the pump or machine.

With a suitable mounting or supporting of the shaft 20 relative to the partition 5 and the supporting of the stroke rings 8, 9 via the mounting shaft or swing shaft 10 on the partition 5, a simple mounting is obtained which, as shown in FIG. 3, guides the radial force locks A and C within the pump.

Figure 4:
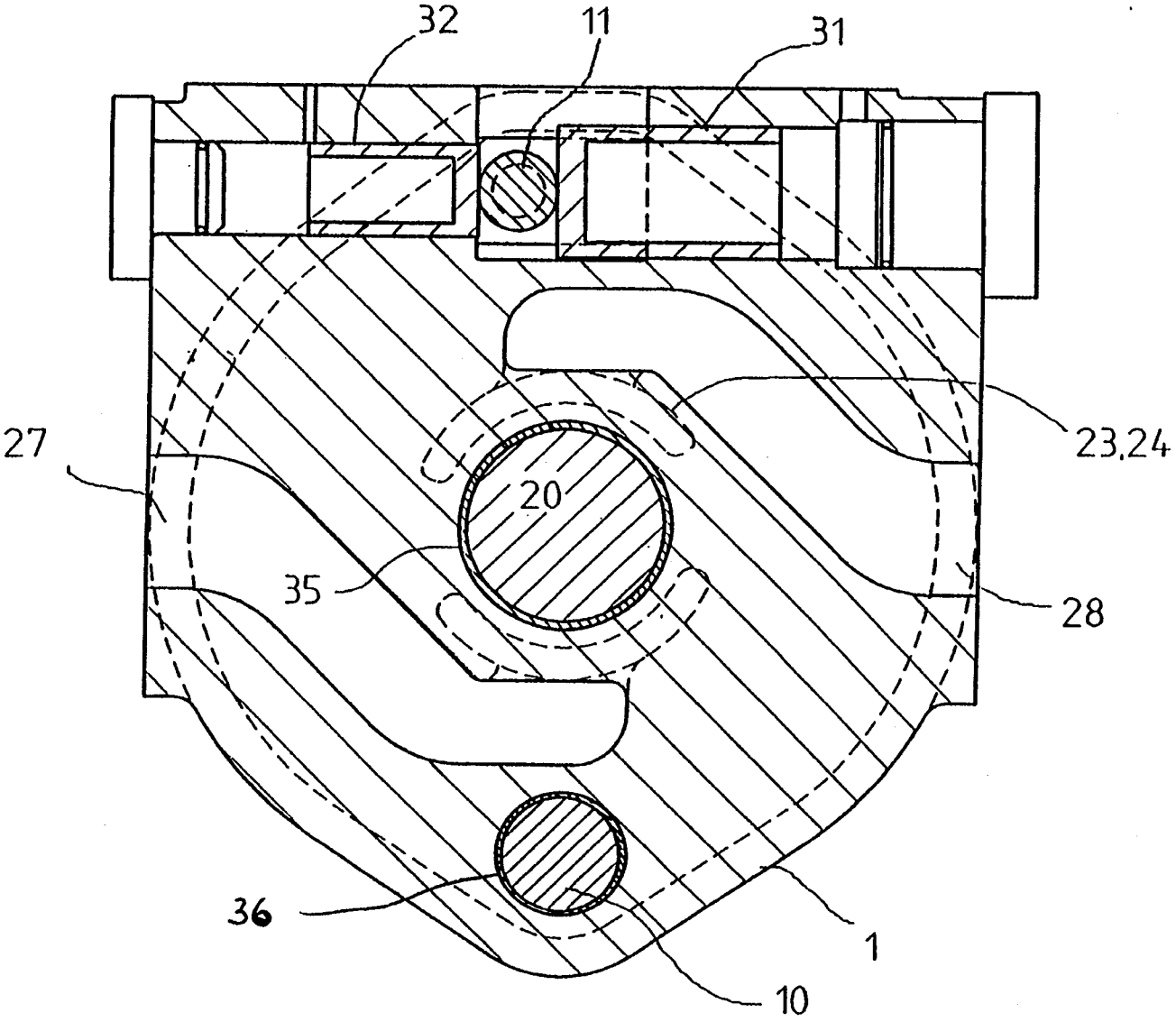
FIG. 4 is a cross section through the pump or hydrostatic machine of FIG. 1, along the section line III—III.

In FIG. 4, the two stroke rings 8, 9 are together positioned via a displacement device comprised of a displacement piston 31 and an opposing piston 32. This displacement device is mounted or developed and acts on the partition 5. The connecting channels 27, 28, i.e. the inlet side low pressure channel and the outlet-side high pressure channel, are developed in the partition 5.

As mentioned, the rotors 18, 19 are fixed for rotation on and are axially fixed on the shaft 20. Both rotors are seated in dismountable manner on the shaft 20, using clamping nut 37. The shaft 20 is driven to rotate via a coupling sleeve 40 from the drive bushing 2.

The shaft 20 is stepped to provide a collar 33, 34 for positioning each rotor 18, 19 on the shaft 20. Upon their being mounted, the rotors 18, 19 are pressed by clamping the elements 37 against the respective collars 33 or 34. The distance between the collars 33, 34 is in this connection slightly greater than the sum of the thickness of the partition 5 and the thickness of the control disks 25, 26.

In an alternative, one rotor 18, 19 can also be so fixed on the shaft 20 that the one rotor is developed in one piece with the shaft 20, while the second rotor is fastened to the shaft via a clamping nut. In a special embodiment, it is also possible to fix the two rotors 18, 19 relative to each other, for instance over half the spacing of the radially arranged displacement elements.

By axially fixing the two rotors 18, 19 on the shaft 20, axial forces need not be supported on the housing covers 3. The mounting of the drive shaft 20 via bearing 35 in the partition 5, as well as the mounting of the stroke rings 8, 9 to the same partition 5, permit the force locks A, B and C, all of which act inside of the machine. The slots between the partition 5 and the control disks or axial disks 25, 26, which are necessary for dependable travel of the rotors 18, 19, should be kept as small as possible, because of the tightness, which depends thereon. This is obtained by placing an elastic packing 38, 39, for example O-rings, in the control disks 25, 26 on the sides facing the partition 5. The packing or O-rings, by limiting the pressure fields 29, 30, produce a force against the rotor 18, 19 lying against the packing which is made slightly larger by design than that produced by the pressure field which is distributed over the metallic packing on the rotor side of the control disks 25, 26. In this way, the slot between the rotors 18, 19 and the control disks 25, 26 is kept very small.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A pump with axial thrust compensation comprising:

a housing; a main drive shaft extending through the housing;

two rotors mounted at a distance spaced apart from each other on the drive shaft and rotatable with the shaft and with respect to the housing; each rotor comprising: a body with a plurality of spaced apart radially extending cylinder bores and a respective displaceable element in each bore displaceable into and out of the bore;

a respective displaceable element stroke ring stationary inside the housing for each rotor; means rigidly connecting the stroke rings together at a fixed spacing within the housing; the stroke rings being profiled for engaging each displaceable element of the respective rotor for guiding the displaceable element into and out of the respective bore as the rotors rotate; each displaceable element being so shaped in its bore as to define a chamber beneath the displaceable element in the bore which receives fluid therein and expels fluid therefrom respectively as the displaceable element moves out of the bore and into the bore;

a respective control slot communicating into each bore chamber, the control slots on each rotor being opposed to and directed toward the other rotor;

a partition in the housing disposed between the rotors and particularly between the opposed control slots, the rotors being rotatable with respect to the partition;

a respective first and second control channel at each opposite axial side of the partition placed for communicating with the control slots for the rotors that are at the respective axial side of the partition; the first control channel at each side of the partition extending around a first part of the rotation pathway of the control slots around the partition and being shaped and placed to communicate with the control slots during the time that the displaceable elements are moving out of the bores; the second control channel at each side of the partition extending around a second part of the rotation pathway of the control slots around the partition and being shaped and placed to communicate with the control slots during the time that the displaceable elements are moving into the bores; the first control channels serving as inlet channels to the bores and the second control channels serving as outlet channels from the bores;

a fluid inlet to the inlet channels and a fluid outlet from the outlet channels.

2. The pump of claim 1, wherein the housing is enclosed around the stroke rings and the rotors.

3. The pump of claim 1, further comprising a respective control disk at each axial side of the partition and the channels in the partition are defined in the control disks.

4. The pump of claim 3, wherein the control disks are sealed to the partition against leakage.

5. The pump of claim 1, wherein the fluid inlet and the fluid outlet both extend into and through the partition.

6. The pump of claim 1, wherein the means rigidly connecting the stroke rings together comprises a bearing shaft in the housing to which the stroke rings are rigidly connected.

7. The pump of claim 6, further comprising a respective shaft bearing in the partition for each of the main shaft for the rotors and the bearing shaft for the stroke rings.

8. The pump of claim 1, wherein the bearing shaft is shaped to define a respective collar thereon and facing toward each of the rotors; clamping elements acting on the rotors for urging the rotors against the collars.

9. The pump of claim 8, wherein the collars are spaced a distance apart which is greater than the sum of the thickness of the partition and the control channels therein.

10. The pump of claim 9, wherein the housing is enclosed around the stroke rings and the rotors.

* * * * *